US006275247B1

(12) United States Patent
Masubuchi et al.

(10) Patent No.: US 6,275,247 B1
(45) Date of Patent: Aug. 14, 2001

(54) OPTICAL PRINTER APPARATUS

(75) Inventors: Sadao Masubuchi, Chofu; Sigeru Futakami, Tokorozawa; Masaaki Matsunaga; Masafumi Yokoyama, both of Tokyo; Akira Shiota, Omiya; Shinichi Nonaka, Ageo; Chikara Aizawa, Fujino-machi, all of (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/155,971

(22) PCT Filed: Feb. 12, 1998

(86) PCT No.: PCT/JP98/00571

§ 371 Date: Oct. 9, 1998

§ 102(e) Date: Oct. 9, 1998

(87) PCT Pub. No.: WO98/35835

PCT Pub. Date: Aug. 20, 1998

(30) Foreign Application Priority Data

Feb. 12, 1997 (JP) ..... 9-027374
Nov. 20, 1997 (JP) ..... 9-319256

(51) Int. Cl.[7] ..... B41J 2/45; B41J 2/47
(52) U.S. Cl. ..... 347/232
(58) Field of Search ..... 347/232, 257, 347/245, 237, 138, 135, 132, 130, 234, 238, 242, 258, 137, 244, 239

(56) References Cited

U.S. PATENT DOCUMENTS

| | | | | |
|---|---|---|---|---|
| 4,757,327 | | 7/1988 | Henzi | 347/237 |
| 4,928,122 | * | 5/1990 | Doi et al. | 346/160 |
| 5,600,363 | * | 2/1997 | Anzaki et al. | 347/237 |
| 5,712,674 | * | 1/1998 | Doi | 347/238 |

FOREIGN PATENT DOCUMENTS

| | | |
|---|---|---|
| 2-169270 | 6/1990 | (JP) . |
| 2-287527 | 11/1990 | (JP) . |
| 3-61556 | 3/1991 | (JP) . |
| 5-8445 | 1/1993 | (JP) . |
| 8-1998 | 1/1996 | (JP) . |
| 8-201930 | 8/1996 | (JP) . |

* cited by examiner

*Primary Examiner*—N. Le
*Assistant Examiner*—Kristal Feggins
(74) *Attorney, Agent, or Firm*—Smith, Gambrell & Russell, LLP

(57) ABSTRACT

The present invention uses LEDs as the light source in a optical printer employing a line scanning method in which an image is produced by relative motion of the light to a photosensitive medium. LEDs are arranged on a mounting substrate with LED pairs, each pair being of the same color, disposed symmetrically as to the center point of the line. Similarly, the power supply lead wires for the LEDs are also disposed symmetrically. In mounting the components on the mounting substrate, a light-intercepting material is used for intercepting light from the side faces of the LEDs.

12 Claims, 9 Drawing Sheets

OPTICAL PRINTER APPARATUS

TECHNICAL FIELD

This invention relates to an optical printer apparatus designed for producing an image while relatively moving a light from a light source comprising light-emitting diodes (hereinafter LEDs) with respect to a photosensitive medium and irradiating the medium at a predetermined timing, more particularly to a design for an LIED array employed in a line scanning optical printer apparatus.

BACKGROUND ART

Video printers are widely used for printing onto a photosensitive sheet images digitally processed and displayed on a display. Printing methods for video printers include thermal method, ink-jet method, laser beam scanning method, and liquid crystal shutter method. Of these methods, the optical printer method, wherein the image is formed by exposure of a photosensitive medium with light from a light source under exposure timing controlled by a liquid crystal shutter, has attracted attention for its suitability to compact, lightweight designs. Prior art examples of such optical printer method are disclosed in Japanese Laid-Open Patent Application 2-287527 and 2-169270.

The prior art examples cited above will be described referring to FIG. 9. In FIG. 9, a casing 11 houses a film loading section 12 that contains a film pack FP containing a plurality of sheets of self-processing film F, each being a photosensitive medium. Located adjacent to the opening 13 of the film loading section 12 is a set of transport rollers 16 comprising a pair of rim drive rollers 14*a* and 14*b* for drawing out by gripping therewith a predetermined single sheet of film F, which has been exposed, from the film pack FP housed in the film loading section 12 and a pair of ironing rollers 15*a* and 15*b* for developing the exposed film F.

An exposing and recording section 17 for producing the image on the film F is disposed between the rim drive roller pair 14*a* and 14*b* and the ironing roller pair 15*a* and 15*b*. The exposing and recording section 17 includes a light source 18 such as a halogen lamp, and is designed so that the film F is exposed to the light from this light source 18 through an optical fiber bundle 19, color filters (not shown) of three colors (RGB) disposed parallel to the image auxiliary scanning direction, a liquid crystal light valve 20, and a gradient index lens array 21.

A polarizing plate is disposed above and below and to the sides of the liquid crystal light valve 20 with the direction of polarization thereof oriented parallel. A first glass substrate is disposed to the inside of the polarizing plate, one face of this first glass substrate being provided through vacuum evaporation with thin films consisting of coloring matters of three different colors (R, G and B) that serve as color filters (not shown). The other face is provided with transparent electrodes arranged along the color filters (not shown), i.e., a plurality of pixel electrodes disposed in linear fashion in the auxiliary scanning direction.

Liquid crystals such as twisted nematic liquid crystals are sealed between the pixel electrodes and a second glass substrate. At the interface of the second glass substrate with the liquid crystals, a common electrode, being a transparent electrode, is produced through vacuum evaporation at the side of the second glass substrate. The aforementioned polarizing plate is located on the other side of the second glass substrate; light passing through this polarizing plate is directed through the gradient index lens array 21 for the exposure of the film F.

However, the prior art described above employs a halogen lamp or other white light source as the light source, and therefore requires the use of color filters to separate the light from the light source into three colors. This has the disadvantage of lowering the efficiency of utilization of light. Another drawback is the large apparatus size resulting from containing the color filters within the apparatus.

Therefore, it is an object of the present invention to provide an optical printer apparatus that is free from the drawbacks of optical printer apparatus of the prior art, is compact due to the fact that it does not require color filters, and affords high efficiency of utilization of light.

It is a further object of the present invention to provide an optical printer apparatus wherein the LED elements can be installed in such a way as to maximize the efficiency of utilization of the light emitted thereby.

The present invention relates to an optical printer apparatus comprising a photosensitive medium and a light source for emitting a light to be used for the exposure of the photosensitive medium, and designed to form a desired image on the photosensitive medium through the relative motion of the light source with respect to the photosensitive medium while effective the exposure of the photosensitive medium at a predetermined timing, wherein the light source is comprised of light-emitting diodes (LEDs).

BEST MODE FOR CARRYING OUT THE INVENTION

The invention will be illustrated in greater detail by the following description referring to the accompanying drawings.

Figure 1:
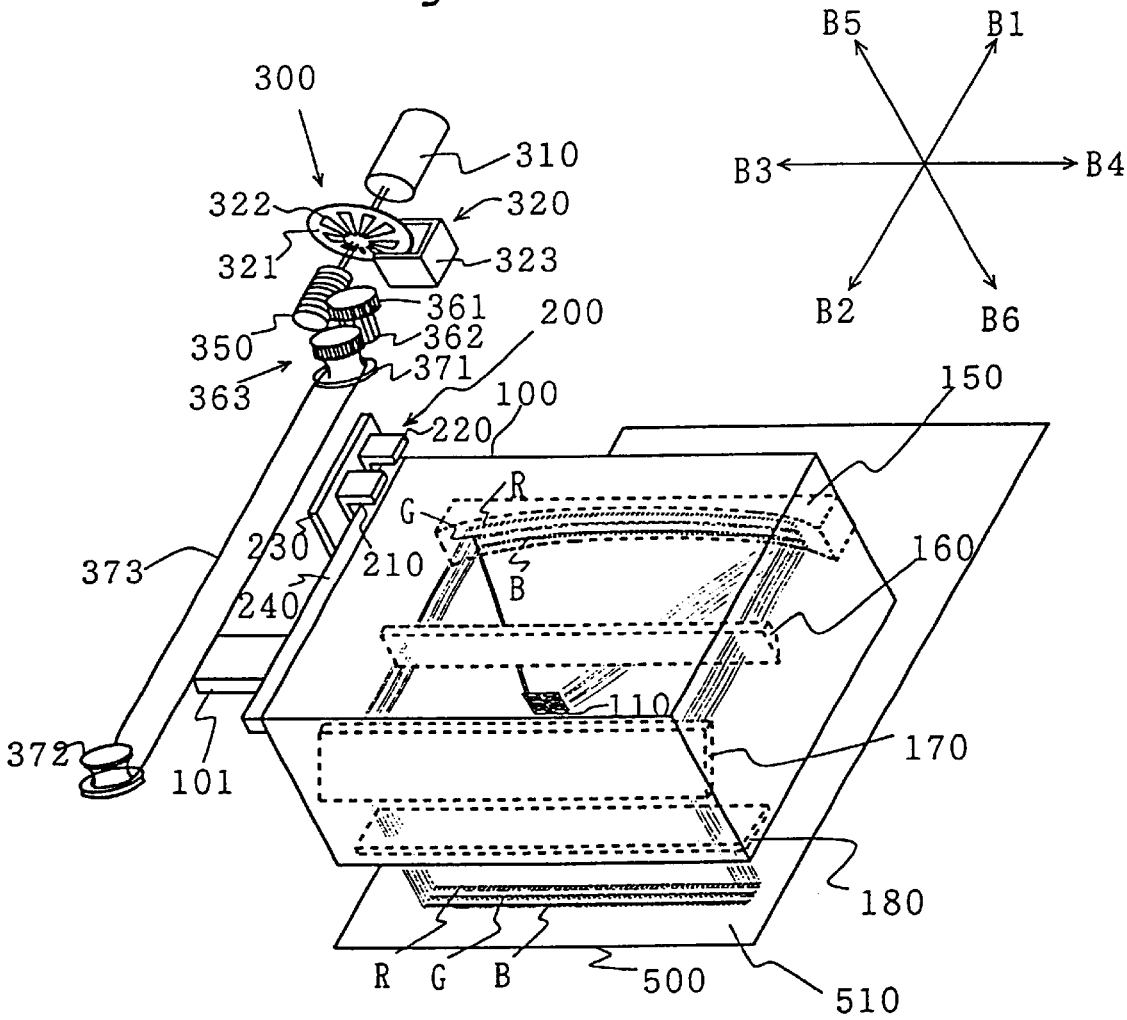
FIG. 1 is a sectional view showing principal elements of the optical printer apparatus which pertains to the present invention.

FIG. 1 is a perspective view showing principal elements of the optical printer apparatus which pertains to the present invention. 100 is an optical head, containing various elements of the optical system; it scans photosensitive paper 500 in the direction indicated by arrow B1. 200 is a head position sensing means and 300 is a head feed means. Next, the constitution of the components of the optical printer apparatus of this embodiment will now be described in detail.

First, the optical head 100 will be described. 110 is an LED mounting substrate for mounting of the LEDs. Details of the design of the LED mounting substrate 110 will be described referring to FIGS. 2 and 3. The LED mounting substrate is mounted with red (R), green (G), and (B) blue LEDs. The R, G and B LEDs are arrayed in this order lying in the direction perpendicular (the B5–B6 direction) to the photosensitive face 510 of the photosensitive paper 500, disposed in the stated order from the direction (B5) more remote from the photosensitive paper face 510 towards the direction (B6) more proximate thereto.

150 is a parabolic mirror for reflecting the light emitted radially by the LEDs mounted on the LED mounting substrate 110, in such a way that this light is rendered parallel to the width (direction B3–B4) of the photosensitive paper 500. 160 is a cylindrical lens for condensing exclusively in the direction perpendicular (direction B5–B6) to the photosensitive paper face 510 the collimated light that has been reflected by the parabolic mirror 150. The focal point of the cylindrical lens 160 is located substantially on the photosensitive paper face 510. 170 is a reflecting mirror for reflecting in the direction perpendicular (direction B5–B6) to the photosensitive paper face 510 the light that is parallel to the photosensitive face and has been reflected by the parabolic mirror 150 passing through the cylindrical lens 160. 180 is a liquid crystal shutter forming 640 pixels extending along the width (direction B3–B4) of the photosensitive paper 500 with a single scanning electrode and 640 signal electrodes.

Next, the head position sensing mechanism will be described. The head position sensing mechanism 200 comprises position sensors 210 and 220, made up of the photointerruptors, affixed to a substrate 230, and a light intercepting plate 240 for switching the photointerruptors 210 and 220. The light intercepting plate 240 is integrally formed with the optical head 100. The length of the light intercepting plate 240 in the travel direction of the optical head 100 (direction B1–B2) is set to be equivalent to the motion stroke of the optical head 100.

Next, the head feed means 300 will be described. 310 is a DC motor. 320 is a rotary encoder comprising a fin 321 and a photointerruptor 323. The fin 321 has a circular shape and the center thereof is fixed to the rotating shaft of the DC motor 310 and thus rotates as the DC motor 310 rotates. The fin 321 is provided with a plurality of openings 322 arranged radially from the rotating shaft at equal intervals in the circumferential direction. The photointerruptor 340 comprises a light-emitting element and a photodetector element (not shown) disposed opposite to each other over an intervening space. The light-emitting element always emits light during operation of the apparatus, and the photodetector element receives the light and senses it in the form of an electrical signal. The fin 321 is disposed between the light-emitting element and photodetector element of the photointerruptor 323 so that, as the fin 323 rotates, the openings 322 allows the light to pass intermittently between the light-emitting element and photodetector element of the photointerruptor 323. A pulsed electrical signal synchronized with this intermittent light is output, allowing the angle of rotation of the DC motor 310 to be sensed.

The rotation of the DC motor 310 is reduced in speed by a worm gear 350 and gears 361, 362, and 363, and is converted to linear reciprocating motion by pulleys 371 and 372 and wire 373. In order to move the optical head 100 in the scanning direction, the wire 373 is secured by a wire securing member 101 projecting from the side face of the optical head 100. In this way, the optical head 100 can be moved with precision at an extremely low speed by the head feed mechanism 300 and the head position sensing mechanism 200.

The operation of the apparatus and the method by which an image is produced on the photosensitive paper will now be described. The LED mounted on the substrate 110 emits light in a sequential manner in the order R, G, B beginning at the top. The light diverges in the direction of width of the photosensitive paper 500 (direction B3–B4), reaching the parabolic mirror 150 (as shown in the drawing, bands of R, G and B light are reflected from the parabolic mirror 150). The light emitted from the LED mounting substrate 110 and diverging in the direction of width of the photosensitive paper 500 is transformed by the parabolic mirror 150 into rays traveling parallel to the width of the photosensitive paper 500, being reflected in the direction opposite that of incidence to reach the cylindrical lens 160.

The cylindrical lens 160 condenses light from the parabolic mirror 150 only in the direction perpendicular (direction B5–B6) to the photosensitive paper face 510. The light condensed by the cylindrical lens 160 is deflected by substantially 90° by means of a flat reflecting mirror 170 and is made to become a light traveling perpendicular to the photosensitive face 510 of the photosensitive paper 500, and finally it passes through the liquid crystal shutter 15 to effect exposure of the photosensitive paper 500.

The light incident on the photosensitive paper 500 is condensed in such a way by the cylindrical lens 160 as to form an image of predetermined size on the photosensitive face 510 of the photosensitive paper 500. The light image of predetermined size produced on the photosensitive face 510 consists of R, G and B light in order from the scanning direction (direction B1).

The optical write process takes place as follows. As the optical head is made to move at a constant rate of speed over the photosensitive paper, and, when the writing start position is sensed by the head position sensing mechanism 200, the R LEDs operate first to emit its light for a predetermined time interval to expose a predetermined area of the photosensitive paper 500. Next, the G LEDs emit light over an equivalent time interval, exposing the photosensitive paper 500 over an area of the same width. Similarly, the B LEDs then emit light over an equivalent time interval to expose the photosensitive paper 500 over an area of the same width as the R and G exposure widths. By moving the optical head at a constant rate of speed over the photosensitive paper 500 while continuously repeating this process in cyclic fashion, each given area on the photosensitive face 510 is exposed light of the three colors, R, G and B, producing a color image.

Further, the exposure times for the three colors, R, G and B are gradation-controlled under the control of the liquid crystal shutter 180, thereby making it possible to produce full-color images. When all the image data has been written and the position sensor 210 is in its turned-off position, the scanning of the optical head 100 is terminated, and the head is returned to the head standby position.

Figure 2:
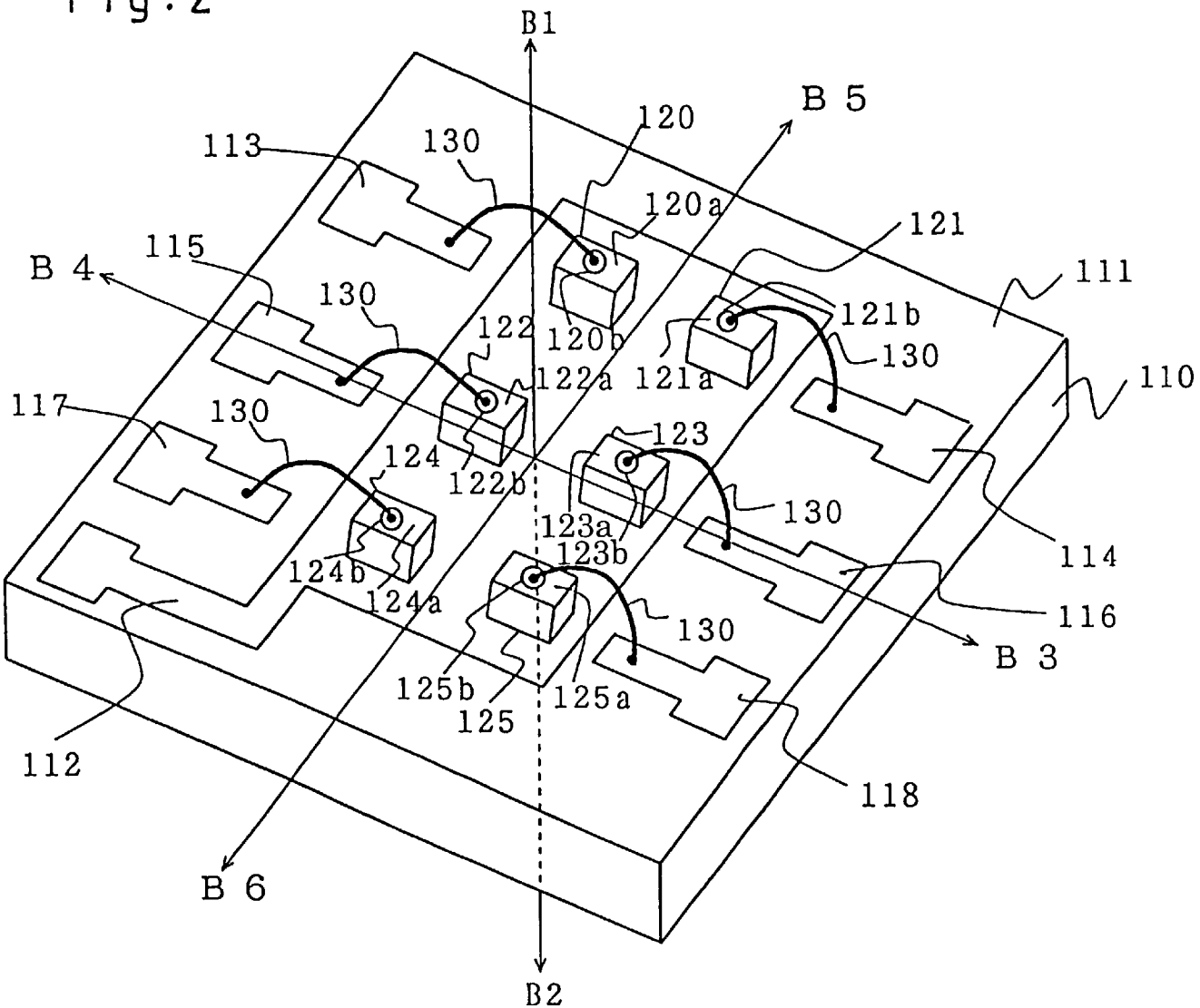
FIG. 2 is a perspective view of LED elements mounted on a substrate in accordance with the present invention.

A detailed description of mounting of the LEDs on the LED mounting substrate 110 will now be given referring to FIGS. 2 and 3. The mounting face 111 of the LED mounting substrate 110 is mounted with six LEDs in total, red (R) LEDs 120 and 121, green (G) LEDs 122 and 123, and blue (B) LEDs 124 and 125, by being disposed symmetrically in two rows with respect to the axis (B5–B6) (in FIG. 1, these are disposed in two rows in the direction of the width of the photosensitive paper 500). In each row [the LEDs] are mounted in the order R, G, B in the direction of arrow B6.

Each of the LEDs 120 through 125 have substantially rectangular shape, one of the faces of each serving as the light-emitting top face 120*a*, 121*a*, 122*a*, 123*a*, 124*a*, and 125*a*. Electrodes 120*b*, 121*b*, 122*b*, 123*b*, 124*b*, and 125*b* are disposed in the centers of the respective light-emitting top faces, while other electrodes (not shown) are provided to the opposing faces opposite the light-emitting top faces. When predetermined voltage is applied across these sets of the two opposing electrodes, the LEDs 120 through 125 emit their lights. The light is emitted in substantially radial direction from the respective light-emitting top faces 120*a* through 125*a*.

The LED mounting substrate 110 is provided in its surface with a single common electrode 112 and six signal electrodes 113, 114, 115, 116, 117, and 118. For the LEDs 120 through 125, the electrodes located opposite the electrodes 120*b* through 125*b* are bonded to the common electrode 112 through a conductive adhesive (such as silver paste). The electrodes 120*b* through 125*b* are electrically connected to the signal electrodes 113 through 118 by wires 130 consisting of gold wire or the like. As noted earlier, voltage is applied to light up the LEDs in such a way that the printing paper 500 is exposed at a predetermined timing according to the image data.

As noted with reference to FIG. 1, the light emitted from the light-emitting top faces 120*a* through 125*a* of the LEDs 120 through 125 produces R, G and B lines on the photosensitive face 510 of the photosensitive paper 510. It is essential for each of the R, G and B lines to have a uniform quantity of light over their entire region. In the LED arrangement illustrated in FIG. 2, the LEDs are disposed symmetrically about the axis (B5–B6), with the direction of the wires connecting the LEDs to the substrate being symmetrical about the axis (B5–B6) as well. Accordingly, LED light emission is symmetrical about the axis (B5–B6), and the R, G and B lines exhibit substantially equal quantities of light over their lengthwise extension, i.e., across the width of the photosensitive paper 510.

Figure 3:
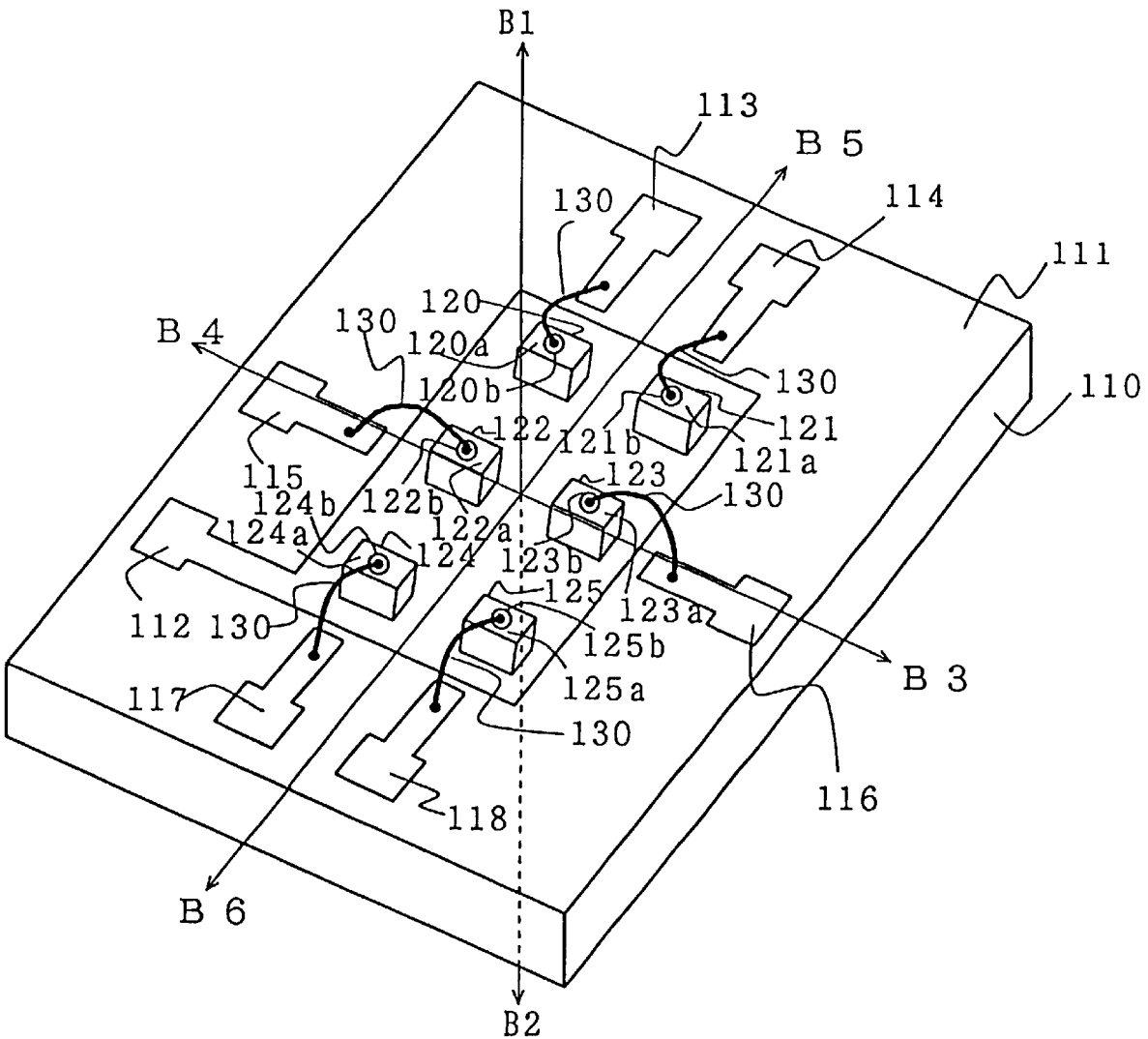
FIG. 3 illustrates a modification of the embodiment illustrated in FIG. 2.

FIG. 3 illustrates an alternative example of the mounting arrangement of the LEDs 120 through 125 on the LED mounting substrate 110. The signal electrodes 113 through 118 are mounted in four directions on the substrate and the wires 130 therefrom are connected to the substrate. As in FIG. 2, however, the arrangement is symmetrical about the axis (B5–B6), so that the same effect as in the embodiment illustrated in FIG. 2 is obtained.

Figure 4A:
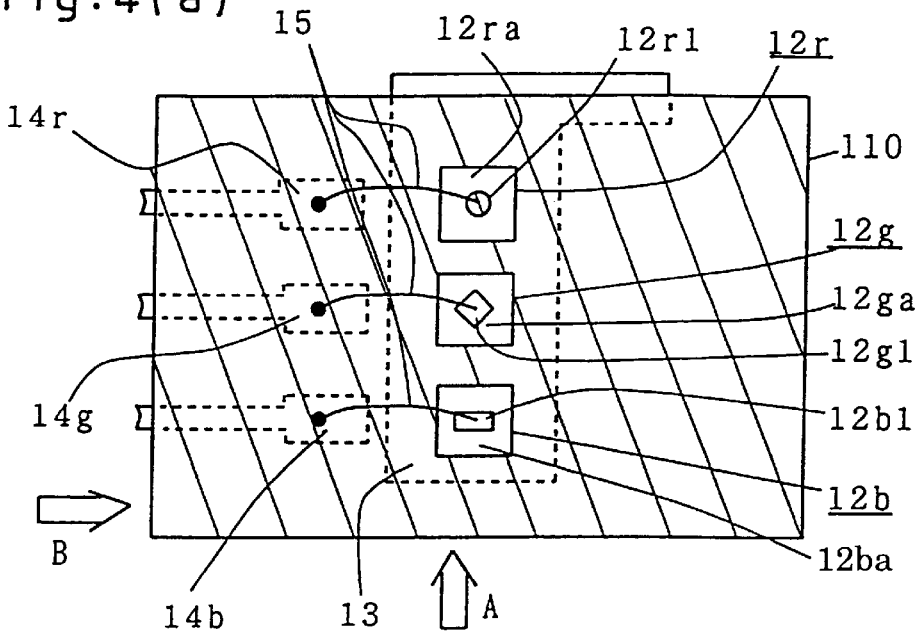
FIGS. 4(*a*)–4(*c*) illustrate LED elements mounted on a substrate in accordance with present invention, the light to the LED elements being intercepted with a light-intercepting member.
Figure 4B:
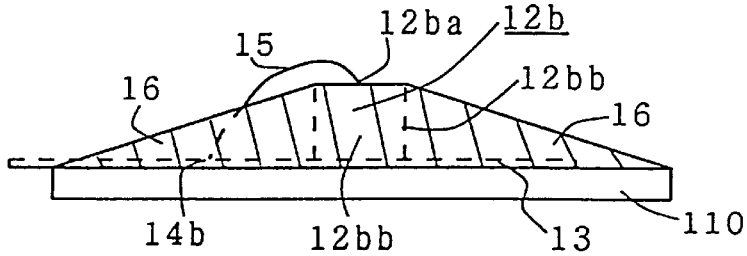
Figure 4C:
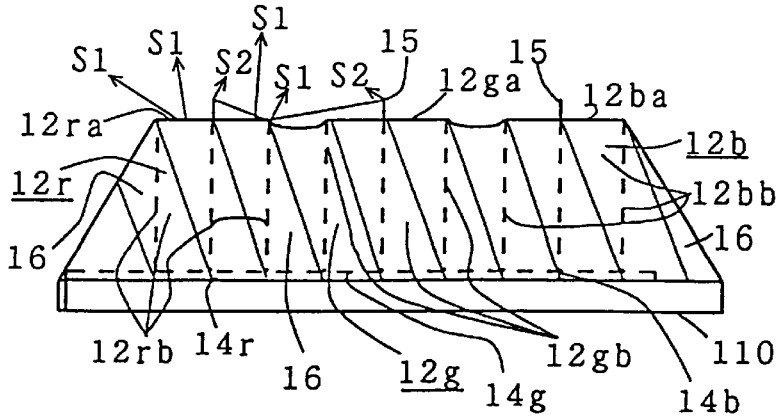

Another embodiment for LED mounting pertaining to the present invention is illustrated in FIG. 4. FIG. 4(*a*) is a top view of the mounted LED elements, FIG. 4(*b*) is a side view of FIG. 4(*a*) in the direction of arrow A, and FIG. 4(*c*) is a side view of FIG. 4(*a*) in the direction of arrow B. In FIGS. 4(*a*)–4(*c*), a substantially red (R) LED 12*r*, a substantially green (G) LED 12*g*, and a substantially blue (B) LED 12*b* are disposed at predetermined intervals on the LED mounting substrate 110. Each of the LEDs 12*r*, 12*g*, and 12*b* has substantially a rectangular form with one face thereof constituting the principal light-emitting top face, namely, 12*ra*, 12*ga* or 12*ba*. Electrodes 12*r*1, 12*g*1 and 12*b*1 are provided in the centers of the respective the light-emitting top faces 12*ra*, 12*ga*, and 12*ba*, and other electrodes (not shown) are provided to the opposing faces opposite these light-emitting top faces.

The surface of the LED mounting substrate 110 is provided with a single common electrode 13 and three signal electrodes 14*r*, 14*g*, and 14*b*. For LEDs 12*r*, 12*g*, and 12*b*, the electrodes (not shown) located on the opposite side of the light-emitting top faces are secured to the common electrode 13 using a conductive adhesive. The electrodes 12*r*1, 12*g*1 and 12*b*1 on the principal light-emitting top faces are electrically connected, through lead wires 15 consisting of gold wire or the like to the respective signal electrodes 14*r*, 14*g*, and 14*b*. A light-intercepting filling material 16 consisting of a black or other light-intercepting resin is applied over the substrate 110 so as to cover the side faces 12*rb*, 12*gb* and 12*bb* located adjacently to the principal light-emitting top faces of the LEDs 12*r*, 12*g*, and 12*b*. In this example, the application of the light-intercepting filling material 16 can be accomplished either by coating with or dipping into the light intercepting filler material 16 the substrate with the lead wires 15 completely connected thereto. In practice, the light-intercepting filling material 16 is preferred to be a thermosetting resin in terms of manufacturing.

When a predetermined voltage is applied to the three electrodes disposed opposite to the LEDs 12*r*, 12*g* and 12*b* from a light source drive circuit (not shown) through the common electrode 13 and the signal electrodes 14*r* 14*g* and 14*b*, the light-emitting top faces 12*ra*, 12*ga* and 12*ba* and the side faces 12*rb*, 12*gb* and 12*bb* emit the light either one at a time or more than one at the same time.

Figure 5:
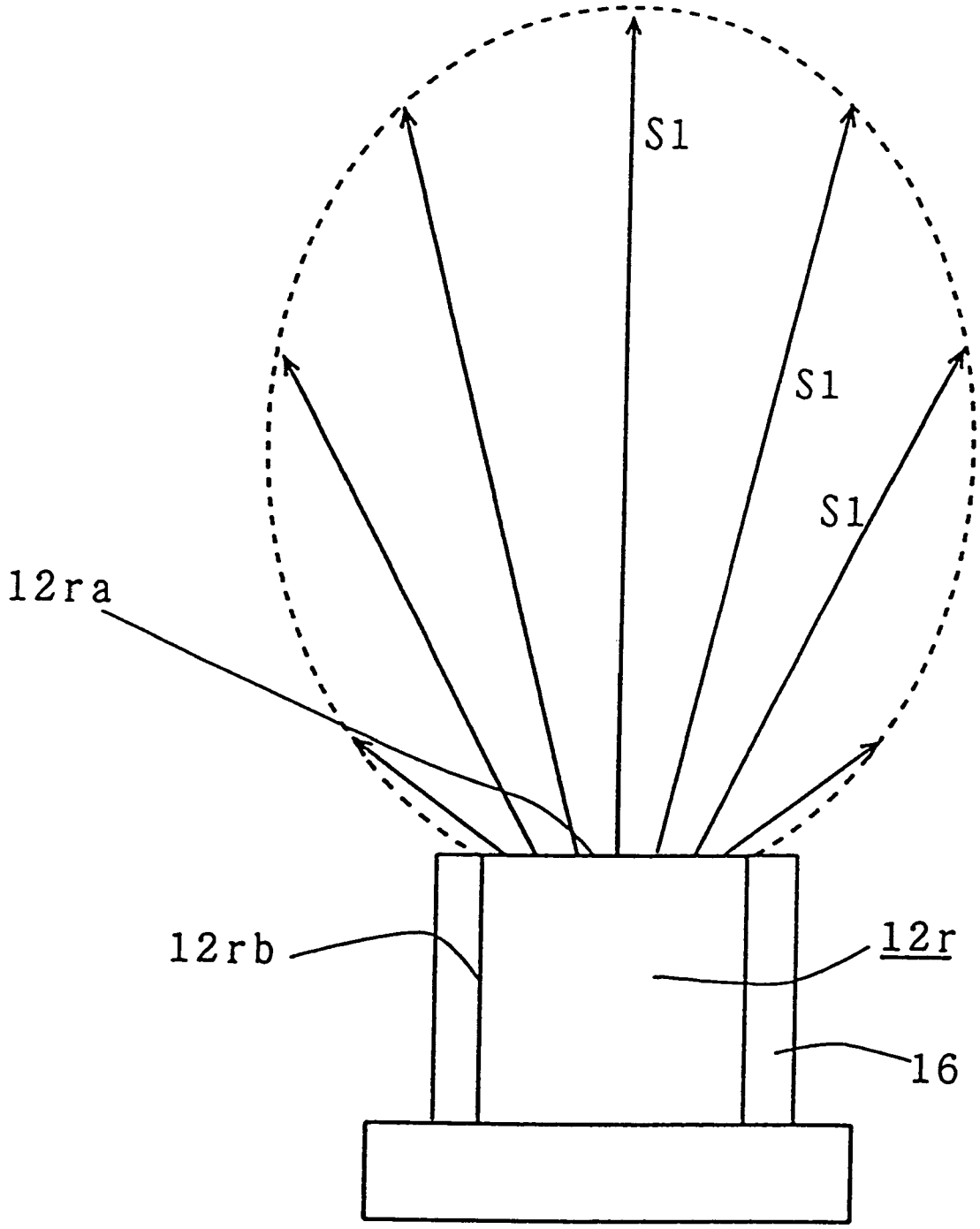
FIG. 5 is a diagram depicting directionality of light emitted by LEDs used in the embodiment.

FIG. 5 is a diagram showing the directionality of actual light from the red LED 12*r* in this example. As shown in FIG. 5, in this embodiment the side face 12*rb* of the LED 12*r* is shielded by the packed light intercepting filler material 16 to prevent the light from being emitted from the side face 12*rb*, so that the light is emitted radially to the outside from the principal light-emitting top face 12*ra*, thereby improving the directionality of light emission by the LED 12*r* and eliminating components from below the light-emitting top face. As a result, the emitted light substantially consists of only the primary light (S1), as shown in FIG. 5, and the emission of a secondary light is substantially prevented except a certain amount of reflection from the lead wires 15. This applies to other LEDs 12*g* and 12*b* too.

In the arrangement of the LEDs 12*r*, 12*g* and 12*b* shown in FIG. 4, when the vertical distances from the mounting substrate 110 to the light-emitting top faces 12*ra*, 12*ga* and 12*ba* of each of the LEDs are identical or substantially identical, the light radiated from each light-emitting top face can completely be prevented from being reflected by the other LED or the filling material 16 located in proximity thereto, thereby completely intercepting the emission of secondary light except a certain amount of reflection from the lead wires 15, as shown in FIG. 4(*c*). Since the lead wires 15 are thin, the quantity of secondary light produced by reflection therefrom is considerably small as compared with the quantity of primary light emitted from the principal light-emitting top faces.

Figure 6A:
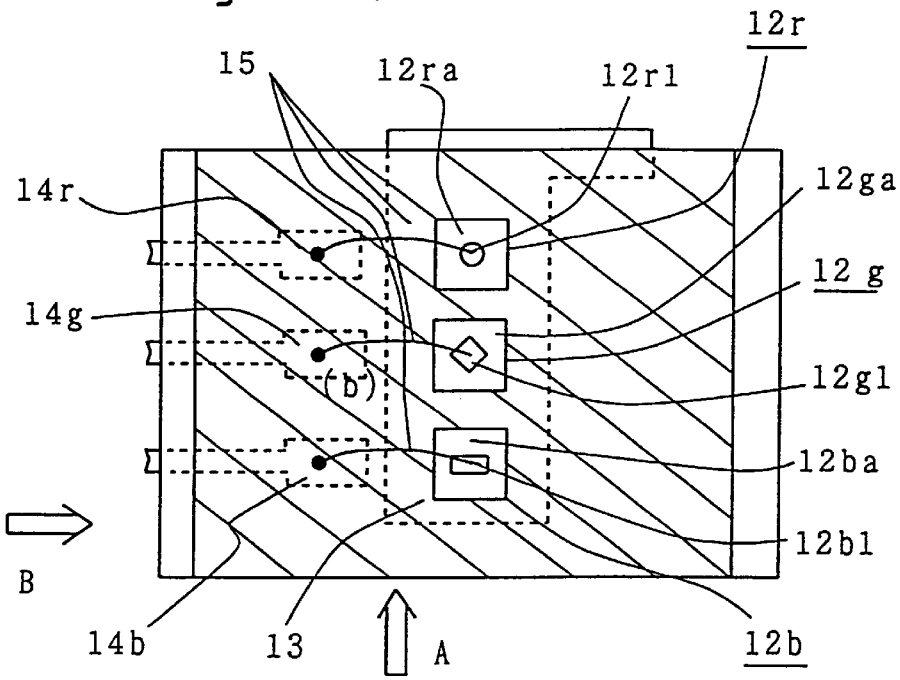
FIGS. 6(*a*)–6(*c*) illustrate a second embodiment, wherein the light to the LED elements mounted on a substrate in accordance with the present invention is intercepted with the light-intercepting member.
Figure 6B:
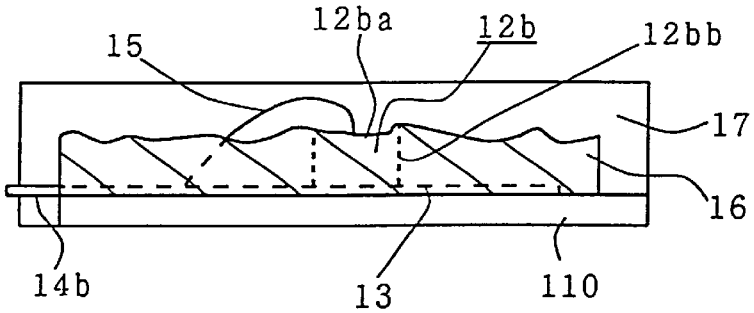
Figure 6C:
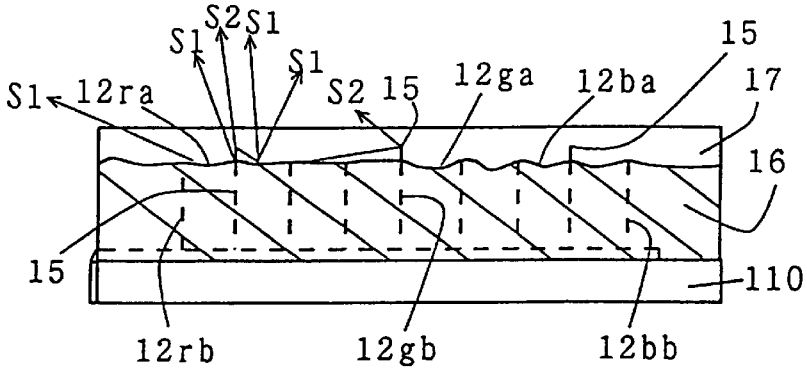

A modification of the embodiment discussed with reference to FIGS. 4(*a*)–(*c*) will now be described. FIG. 6(*a*) is a top view of mounted LED elements, FIG., 6(*b*) is a side view of FIG. 6(*a*) in the direction of arrow A, and FIG. 6(*c*) is a side view of FIG. 6(*a*) in the direction of arrow B. In FIGS. 6(*a*)–(*c*), the configuration of the LED mounting substrate 110, the LEDs 12*r*, 12*g* and 12*b*, the common electrode 13, the signal electrodes 14*r*, 14*g* and 14*b* and the lead wires 15 are identical with those of the embodiment illustrated in FIG. 4. As shown in FIG. 6, a light intercepting filler material 16, consisting of a substantially rectangular parallelepipedal black or other light intercepting resin, is packed so as to cover the side faces 12*rb*, 12*gb* and 12*bb* located adjacent to the light-emitting top faces. A light-transmissive resin 17 is formed so as to fill in and cover the light-emitting top faces 12*ra*, 12*ga* and 12*ba* and the packed light intercepting filler material 16. These light intercepting filler material 16 and light-transmissive resin 17 can be formed by sequentially injecting liquefied material of the light-intercepting filling material 16 and the light-transmissive resin 17 into a mold, after completing the connection of the lead wires 15.

In this example, the light-emitting top faces 12*ra*, 12*ga* and 12*ba* of the LED and the wires 15 are protected by a light-transmissive resin 17, thereby preventing damage to these elements when the assembly is installed in an optical apparatus or otherwise subjected to handling. The light source in this example is similar to the light source used in the embodiment illustrated in FIG. 4 in terms of the advantages in performance owing to the similar reasons.

In a further modification of this embodiment, any two of the LEDs 12*r*, 12*g*, and 12*b* may be omitted from the design illustrated in FIG. 4 or FIG. 6, leaving only one LED and using only one signal electrode 14. This example is suitable for use as a light source in an optical apparatus for providing monochrome data.

Figure 7:
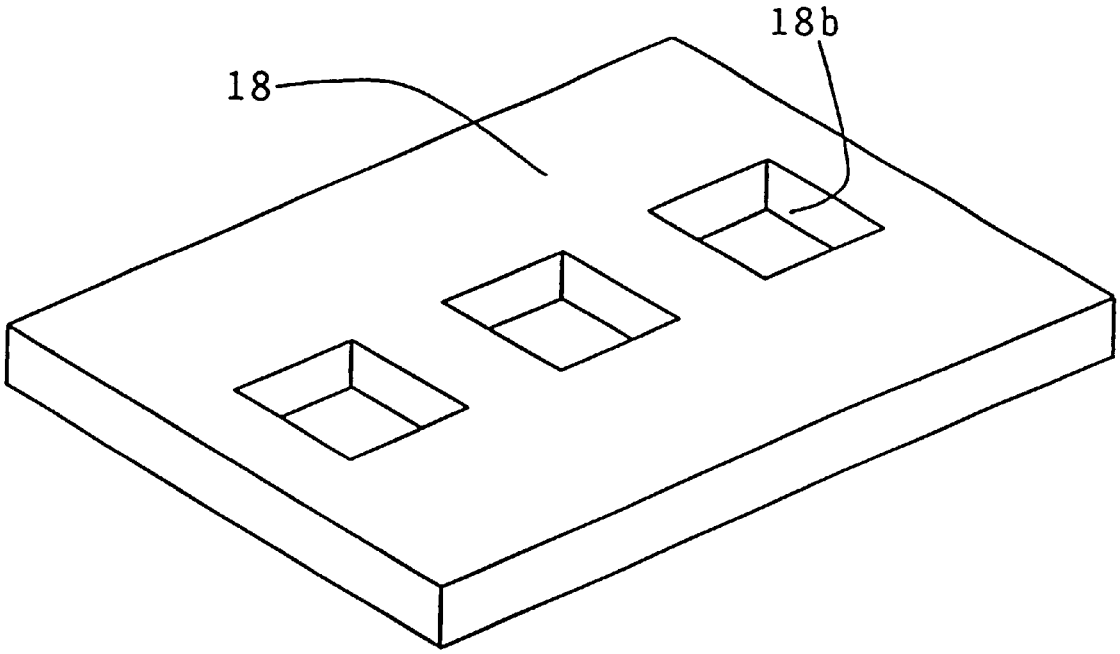
FIG. 7 illustrates a modification of light intercepting member in accordance with the present invention.

A still further modification of this embodiment will be described referring to the drawings. FIG. 7 is a perspective view illustrating the use of a masking element 18 as the side light-intercepting means, a substitute for the light intercepting filler material 16, used in the embodiments illustrated in FIGS. 4 and 6. The masking element 18 is an independently formed solid mask of a light-intercepting insulating material colored black or the like. The masking element 18 takes the form of a substantially rectangular parallelepipedal plate having a thickness substantially equivalent to the height of the LEDs, consists of rubber, a resin or the like, and is provided, by molding or the like, with through-holes 18*b* shaped for receiving the LEDs. The masking element 18 can substitute for the light intercepting filler material 16 illustrated in FIGS. 4 and 6. To describe the installation procedure of the masking element 18, a conductive adhesive (or, if necessary, an adhesive for fixing the mask) is applied to the common electrode 13 illustrated in FIG. 4 or 6, the masking element 18 is placed over the common electrode 13 with the LEDs 12*r*, 12*g*, and 12*b* fitted into the through-holes 18*b*, and the electrodes provided to the faces opposite the light-emitting top faces are secured to the common electrode 13 by means of the conductive adhesive.

The electrodes 12*r*1, 12*g*1 and 12*b*1 of the light-emitting top faces are then electrically connected to the respective signal electrodes 14*r*, 14*g* and 14*b* through lead wires 15 such as gold wires or the like. Further, if necessary, a light-transmissive resin 17 is applied, by filling method, to cover the light-emitting top faces 12*ra*, 12*ga*, and 12*ba*, the masking element 19, and the wires 15. In the case of the light source of this example, the side faces of the LEDs are shielded by the masking element 18, thereby offering the advantages in performance similar to those of the light source used in the embodiment illustrated in FIG. 4, owing to similar reasons. In assembling, the masking element 18 is also employed for positioning of the LEDs, thus facilitating the assembly process and improving positional accuracy.

Figure 8A:
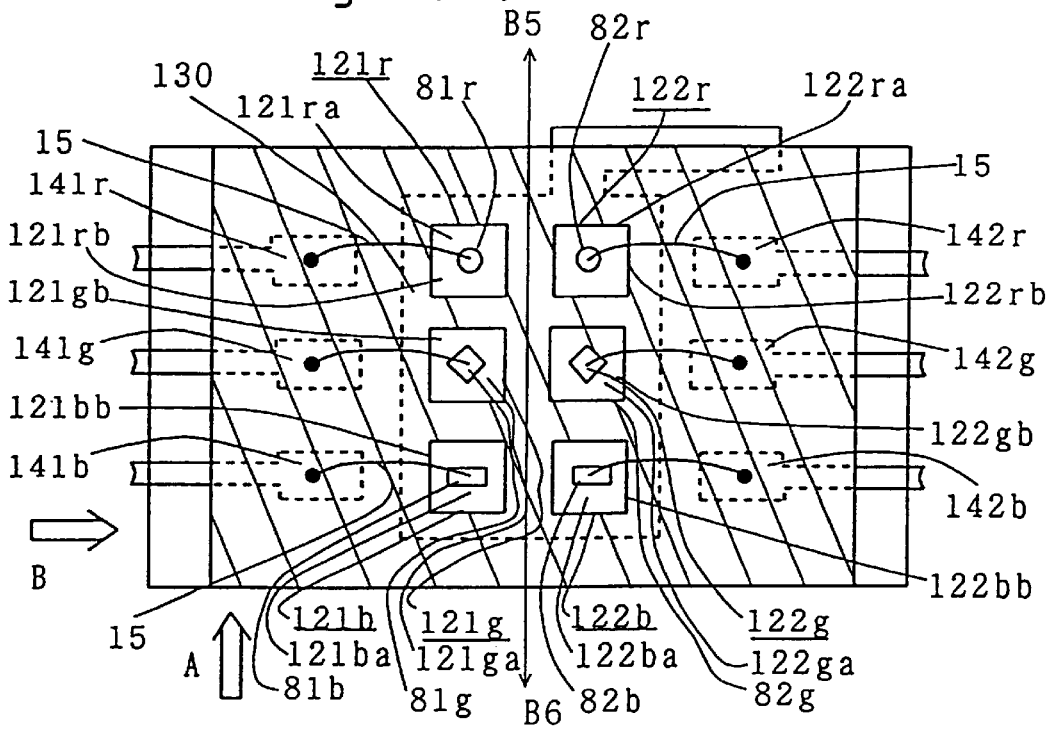
FIGS. 8(*a*)–8(*c*) illustrate the embodiment illustrated in FIG. 1, which is intercepted with the light-intercepting member.
Figure 8B:
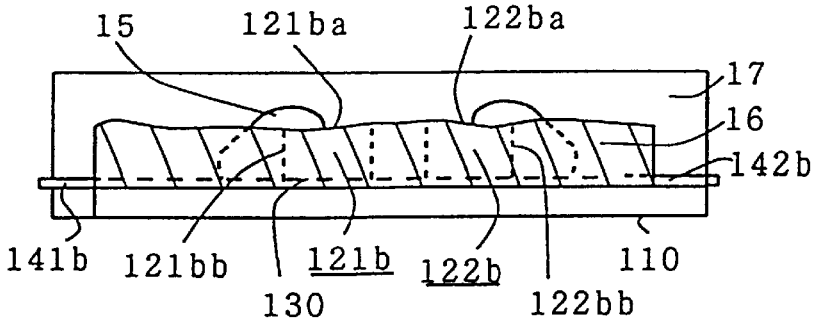
Figure 8C:
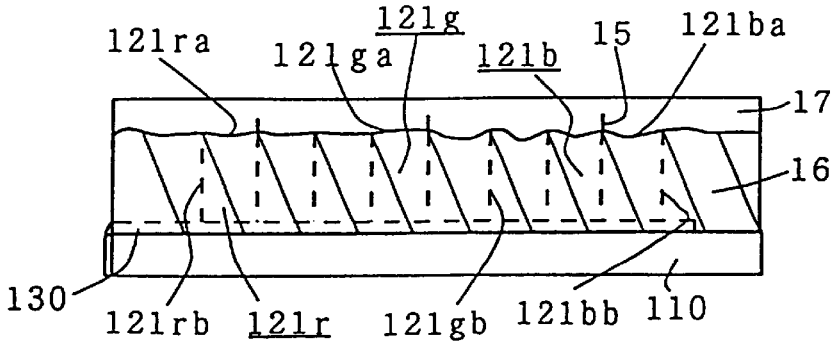
Figure 9:
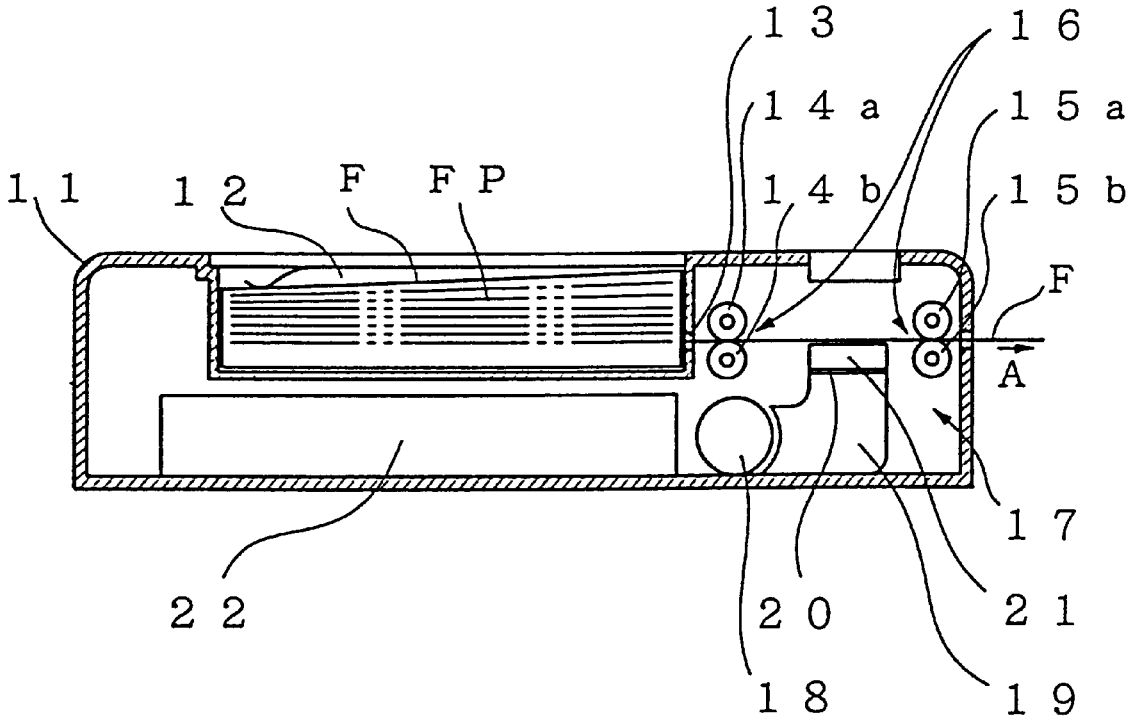
FIG. 9 illustrates a prior art embodiment of an optical printer apparatus.

A still further preferred embodiment of the present invention will now be described referring to FIGS. 8(*a*)–(*c*). FIG. 8(*a*) is a top view of mounted LED elements, FIG. 8(*b*) is a side view of FIG. 8(*a*) in the direction of arrow A, and FIG. 8(*c*) is a side view of FIG. 8(*a*) in the direction of arrow B. As shown in FIG. 8, the LED mounting substrate 110 is provided with a total of six LEDs, LEDs 121*r* and 122*r* of R, LEDs 121*g* and 122*g* of G, and LEDs 121*b* and 122*b* of B, disposed in two rows symmetrically with respect to the axis represented by B5–B6. Within each row, the LEDs are arranged in the order of R, G and B in direction B6.

The LEDs are substantially rectangular parallelepipeds, which are similar in shape to those of the LEDs illustrated in FIG. 4, and are provided with light-emitting top faces 121*ra*, 122*ra*, 121*ga*, 122*ga*, 121*ba*, and 122*ba* and with side faces 121*rb*, 122*rb*, 121*gb*, 122*gb*, 121*bb*, and 122*bb*. Electrodes 81*r*, 82*r*, 81*g*, 82*g*, 81*b*, and 82*b* are provided to the centers of the respective light-emitting top faces. Other electrodes (not shown) are provided to the opposing faces opposite the light-emitting top faces.

The surface of the mounting substrate 110 is provided with one common electrode 130 and six signal electrodes 141*r*, 142*r*, 141*g*, 142*g*, 141*b*, and 142*b*. For the LEDs 121*r*, 122*r*, 121*g*, 122*g*, 121*b*, and 122*b*, their respective electrodes arranged opposite the electrodes 81*r*, 82*r*, 81*g*, 82*g*, 81*b*, and 82*b* which are provided to the light-emitting top faces, are secured to the common electrode 30 using a conductive adhesive. The electrodes 81*r*, 82*r*, 81*g*, 82*g*, 81*b*, and 82*b* are electrically connected to the signal electrodes 141*r*, 142*r*, 141*g*, 142*g*, 141*b* and 142*b* through lead wires 15 such as the gold wires or the like. As in the embodiment illustrated in FIG. 4(*b*) and FIG. 4(*c*), a light intercepting filler material 16 made from a light-intercepting resin colored black or other color is applied over the substrate 110 to cover the side faces 121*rb* through 121*bb* of the LED, and a light-transmissive resin 17 is applied to cover the light-emitting top faces 1221*ra* through 122*ba* and the packed light intercepting filler material 16. The lead wires 15 are also covered and protected by the light intercepting filler material 16 and the light-transmissive resin 17.

As shown in FIG. 8, in this embodiment, the LEDs 121*r* through 122*b* and the wires 15 are arranged in substantially symmetrical fashion about the axis represented by B5–B6. When a predetermined voltage is applied across the two opposing electrodes of an LED, the LED emits a light. On a basic principle similar to that of the embodiment illustrated in FIG. 2, primary light is emitted only from the light-emitting top faces 121*ra* through 122*ba* of the LEDs in the case of the light source of this embodiment, and no secondary light is emitted except that resulting from the reflection by the lead wires 15.

What is claimed is:

1. An optical printer apparatus for printing on a photosensitive medium, said optical printer apparatus comprising:

a light source, composed of light emitting diodes (LEDs), for emitting a light for exposure of the photosensitive medium; and a conversion means for converting light from said light source to light in the form of a line in the longitudinal direction; wherein said photosensitive medium is irradiated and exposed, at a predetermined timing, by the light converted from said light source, wherein said light source is caused to make a relative motion with respect to the photosensitive medium in the direction perpendicular to said line in the longitudinal direction so that an image is produced on the photosensitive medium; and said LEDs are fixedly mounted on a LED mounting substrate in the form of at least one pair of LEDs consisting of two LEDs of the same color in a fashion such that two LEDs of the pair are arranged leaving an interval therebetween and substantially symmetrical with each other with respect to the center of said line in the longitudinal direction, and further, a power supplying lead wire which connects the upper surface of one of the LEDs of the pair with said LED mounting substrate is substantially symmetrical with a power supplying lead wire which connects the upper surface of the other of the LEDs of the pair with said LED mounting substrate with respect to the center of said line in the longitudinal direction.

2. The optical printer apparatus according to claim 1, wherein a liquid crystal shutter for controlling light intercepting or light transmitting is disposed between said conversion means and said photosensitive medium.

3. The optical printer apparatus according to claim 2, wherein said conversion means is composed of:

a parabolic mirror for reflecting radially directed light from said LEDs to parallelly directed light along a line in the longitudinal direction;

a cylindrical lens for condensing the light coming from said parabolic mirror only in the direction perpendicular to said line in the longitudinal direction; and a reflecting mirror for changing the direction of the light from said cylindrical lens.

4. The optical printer apparatus according to claim 1, wherein the light source comprises three LED pairs.

5. The optical printer apparatus according to claim 4, wherein the three LED pairs are colored, substantially of red color, substantially of green color, and substantially of blue color.

6. The optical printer apparatus according to claim 4, wherein, for the power supply lead wires from the top surfaces of the LEDs of the three LED pairs, the wires are led in the lateral direction for the center LED pairs, in an upward direction for the LED pair located at the top end, and in a downward direction for the LED pair located at the bottom end.

7. The optical printer apparatus according to claim 1, wherein the LEDs are electrically connected to a single common electrode provided substantially in the center of a mounting substrate and to signal electrodes corresponding in number to the number of LEDs, located around the perimeter thereof.

8. The optical printer apparatus according to claim 1, wherein the LEDs are mounted on a mounting substrate, and side light intercepting means for intercepting the light emitted from the side faces of the LEDs is provided.

9. The optical printer apparatus according to claim 8, wherein the side light intercepting means is a light intercepting resin applied to cover the side faces of the LEDs.

10. The optical printer apparatus according to claim 9, wherein the light intercepting resin comprises a thermosetting resin.

11. The optical printer apparatus according to claim 9, wherein the sides of LEDs are covered with a light-intercepting resin, while the light-emitting top faces thereof are covered with a light-transmitting resin.

12. The optical printer apparatus according to claim 8, wherein the heights of a plurality of LEDs from the substrate to the light-emitting top faces thereof are substantially equal.

* * * * *